US005397154A

United States Patent [19]

Baldwin

[11] Patent Number: 5,397,154

[45] Date of Patent: Mar. 14, 1995

[54] STABILIZER DEVICE FOR SKIERS

[76] Inventor: Robert I. Baldwin, R.d. 1 Box 87, New Florence, Pa. 15944

[21] Appl. No.: 268,431

[22] Filed: Jun. 30, 1994

[51] Int. Cl.[6] ..... A63C 5/16

[52] U.S. Cl. ..... 280/818; 280/14.1; 280/28.11; 188/8; 434/253; 482/71

[58] Field of Search ..... 280/818, 14.1, 14.2, 280/14.3, 28.11; 188/5, 8; 434/253; 482/71

[56] References Cited

U.S. PATENT DOCUMENTS

| | | | |
|---|---|---|---|
| 1,834,979 | 12/1931 | Skoghind | 280/14.2 |
| 3,529,847 | 9/1970 | Shores | 280/14.3 |
| 4,324,409 | 4/1982 | Larsen et al. | 280/28.11 |
| 4,363,495 | 12/1982 | Henson | 280/818 |
| 4,453,742 | 6/1984 | Zepkowski | 280/818 |
| 4,643,444 | 2/1987 | Pukinson | 280/818 |

FOREIGN PATENT DOCUMENTS

| | | | |
|---|---|---|---|
| 2537012 | 3/1977 | Germany | 482/71 |
| 3414757 | 10/1985 | Germany | 280/14.1 |

*Primary Examiner*—Brian L. Johnson
*Assistant Examiner*—Carla Mattix

[57] ABSTRACT

A new and improved stabilizer device for skiers having two skis, each of the two skis has an upper surface and a lower surface. Two front supports are secured to a corresponding upper surface of the two skis. Two back supports have a triangular support bracket theresecured. Each triangular support bracket is secured to a corresponding upper surface of the two skis. A U-shaped cross member has two convoluted end portions positioned to be secured to the two front supports and to the two back supports. Two brake handles, each of the two brake handles are secured to the U-shaped cross member. Two brake cables are secured to the corresponding brake handle and to the corresponding triangular support bracket of the back support. Two drag brakes are secured to the corresponding triangular support brackets and secured to the brake cables. Two spring mechanisms are secured to the triangular supports brackets and to the drag brakes.

3 Claims, 3 Drawing Sheets

STABILIZER DEVICE FOR SKIERS

BACKGROUND OF THE INVENTION

1. Field of the Invention

The present invention relates to a stabilizer device for skiers and more particularly pertains to aiding a beginning skier to learn the fundamentals of skiing with a stabilizer device for skiers.

2. Description of the Prior Art

The use of ski training devices is known in the prior art. More specifically, ski training devices heretofore devised and utilized for the purpose of ski training are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,973,333 to Caris discloses a snow skiing training device.

U.S. Pat. No. 5,120,227 to Born discloses a ski training device.

U.S. Pat. No. 4,678,183 to Skovasja discloses a device for ski training.

U.S. Pat. No. 4,505,681 to Jones discloses a ski training aid comprised of a handle bar, a waist strap, and a pair of ankle straps.

U.S. Pat. No. 3,729,207 to Reynolds discloses a snow ski training device in the form of skate boards for attachment to the feet of the skier.

While these devices fulfill their respective, particular objective and requirements, the aforementioned patents do not describe a stabilizer device for skiers that aid a beginning skier to learn the fundamentals of skiing.

In this respect, the stabilizer device for skiers according to the present invention substantially departs from the conventional concepts and designs of the prior art, and in doing so provides an apparatus primarily developed for the purpose of aiding a beginning skier to learn the fundamentals of skiing.

Therefore, it can be appreciated that there exists a continuing need for a new and improved stabilizer device for skiers which can be used for aiding a beginning skier to learn the fundamentals of skiing. In this regard, the present invention substantially fulfills this need.

SUMMARY OF THE INVENTION

In the view of the foregoing disadvantages inherent in the known types of ski training devices now present in the prior art, the present invention provides an improved stabilizer device for skiers. As such, the general purpose of the present invention, which will be described subsequently in greater detail, is to provide a new and improved stabilizer device for skiers and method which has all the advantages of the prior art and none of the disadvantages.

To attain this, the present invention essentially comprises two skis, each of the two skis has an upper surface and a lower surface. Two front supports, each of the two front supports has a first end and a second end. Each second end is secured to a corresponding upper surface of the two skis by a fastening means. Two back supports, each of the two back supports has a first end, a second end, and an intermediate extent therebetween. Each second end has a triangular support bracket theresecured. Each triangular support bracket is secured to a corresponding upper surface of the two skis by a fastening means. The device contains a U-shaped cross member having two convoluted end portions and an intermediate extent therebetween. The U-shaped cross member is positioned for the intermediate extent to be secured to the first end of each of the two front supports and to the first end of each of the two back supports.

Two brake handles, each of the two brake handles is secured to the intermediate extent of the U-shaped cross member. Each of the brake handles has a first securement aperture therein. Two brake cables, each of the two brake cables has a first end, a second end, and an intermediate extent therebetween. Each first end is secured to the corresponding first securement aperture of the brake handle. Each second end of the brake cable is secured to the corresponding triangular support bracket of the back support. Each intermediate extent is positioned along the U-shaped cross member and downwardly along the back support. A cable extension has a first end and a second end. The first end of the extension is secured to the second end of the brake cable. Two drag brakes are secured to the corresponding triangular support brackets by a fastening means. Each of the two drag brakes has a first end, a second end, and an intermediate extent therebetween. The first end is secured to the second end of the cable extension. The second end has a generally flat surface designed to grasp snow to act as a stopping mechanism. Two stop pins are secured to the corresponding triangular support brackets and are positioned above the intermediate extent of the drag brake. Two spring mechanisms, each of the two spring mechanisms has a first end and a second end. Each first end is secured to the triangular supports brackets. Each second end is secured to the intermediate extent of the drag brakes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stabilizer device for skiers which has all the advantages of the prior art ski training devices and none of the disadvantages.

It is another object of the present invention to provide a new and improved stabilizer device for skiers which may be easily and efficiently manufactured and marketed.

It is a further object of the present invention to provide a new and improved stabilizer device for skiers which is of durable and reliable construction.

An even further object of the present invention is to provide a new and improved stabilizer device for skiers which is susceptible of a low cost of manufacture with regard to both materials and labor, and which accordingly is then susceptible of low prices of sale to the consuming public, thereby making such a stabilizer device for skiers economically available to the buying public.

Still yet another object of the present invention is to provide a new and improved stabilizer device for skiers which provides in the apparatuses and methods of the prior art some of the advantages thereof, while simultaneously overcoming some of the disadvantages normally associated therewith.

Even still another object of the present invention is to provide a new and improved stabilizer device for skiers for aiding a beginning skier to learn the fundamentals of skiing.

Lastly, it is an object of the present invention to provide a new and improved stabilizer device for skiers having two skis, each of the two skis has an upper surface and a lower surface. Two front supports are secured to a corresponding upper surface of the two skis. Two back supports have a triangular support bracket theresecured. Each triangular support bracket is secured to a corresponding upper surface of the two skis. A U-shaped cross member has two convoluted end portions positioned to be secured to the two front supports and to the two back supports. Two brake handles, each of the two brake handles are secured to the U-shaped cross member. Two brake cables are secured to the corresponding brake handle and to the corresponding triangular support bracket of the back support. Two drag brakes are secured to the corresponding triangular support brackets and secured to the brake cables. Two spring mechanisms are secured to the triangular supports brackets and to the drag brakes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
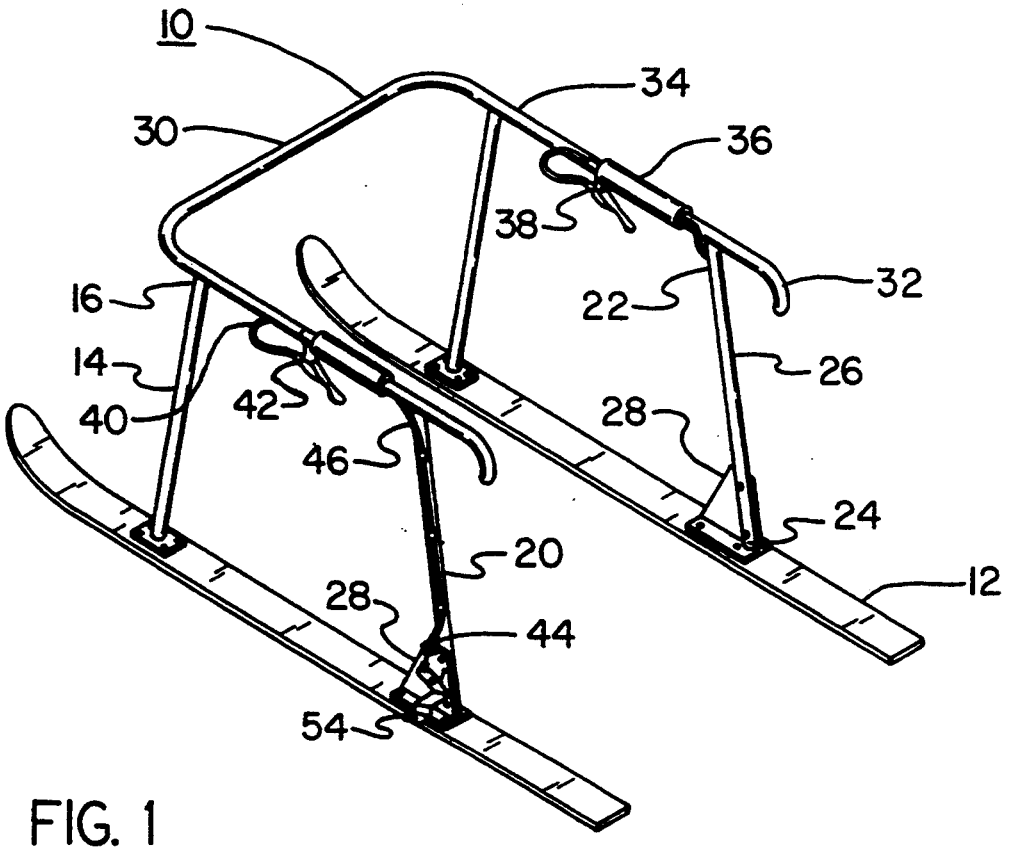
FIG. 1 is a perspective view of the preferred embodiment of the stabilizer device for skiers constructed in accordance with the principles of the present invention.
Figure 2:
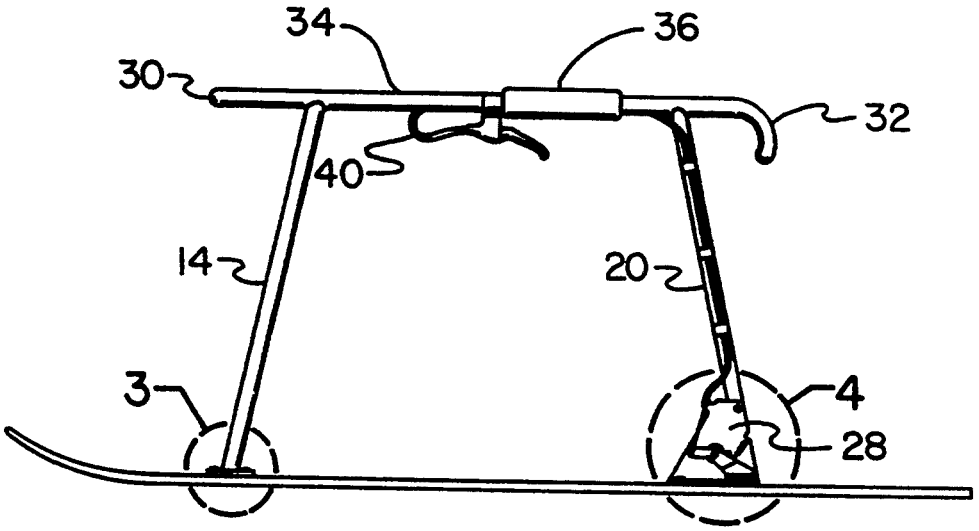
FIG. 2 is a side view of the present invention showing all elements.
Figure 3:
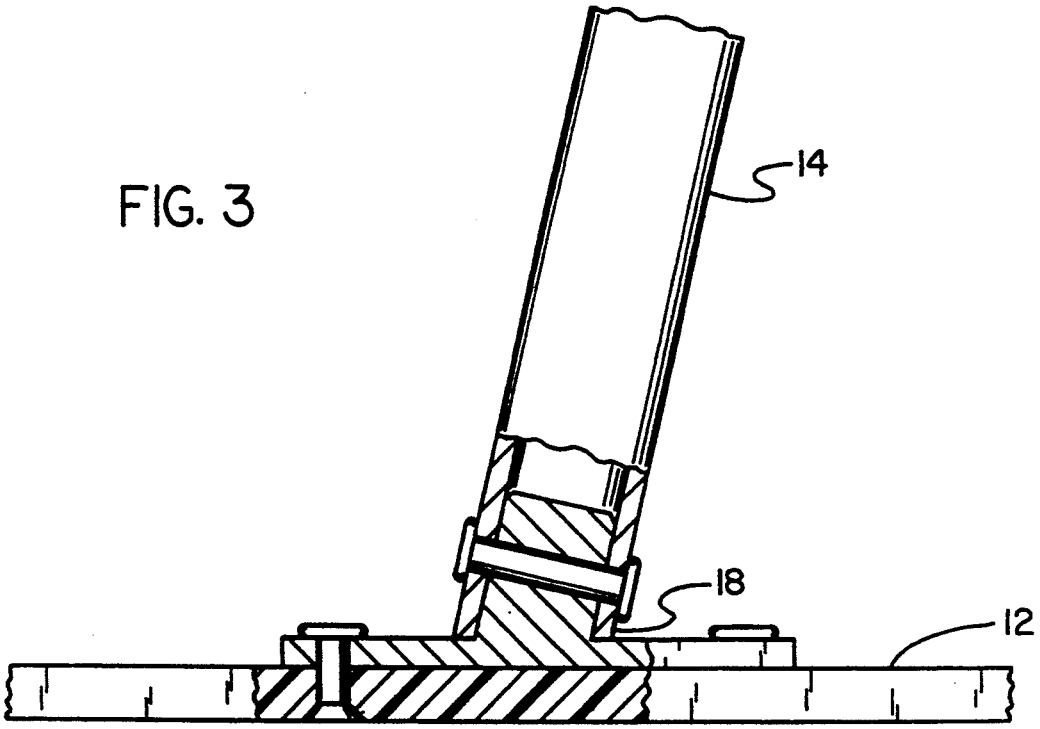
FIG. 3 is an enlarged view of the front leg attachment taken along line 3 of FIG. 2.
Figure 4:
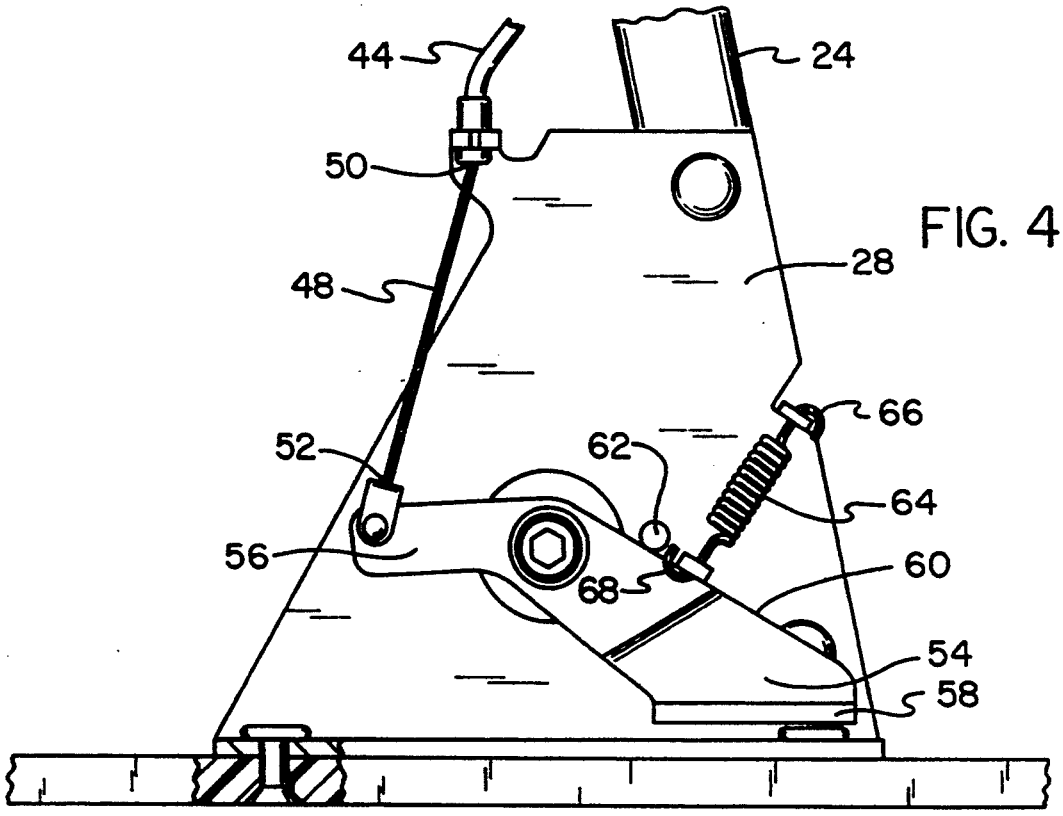
FIG. 4 is an enlarged view of the brake element as taken along line 4 of FIG. 2.
Figure 5:
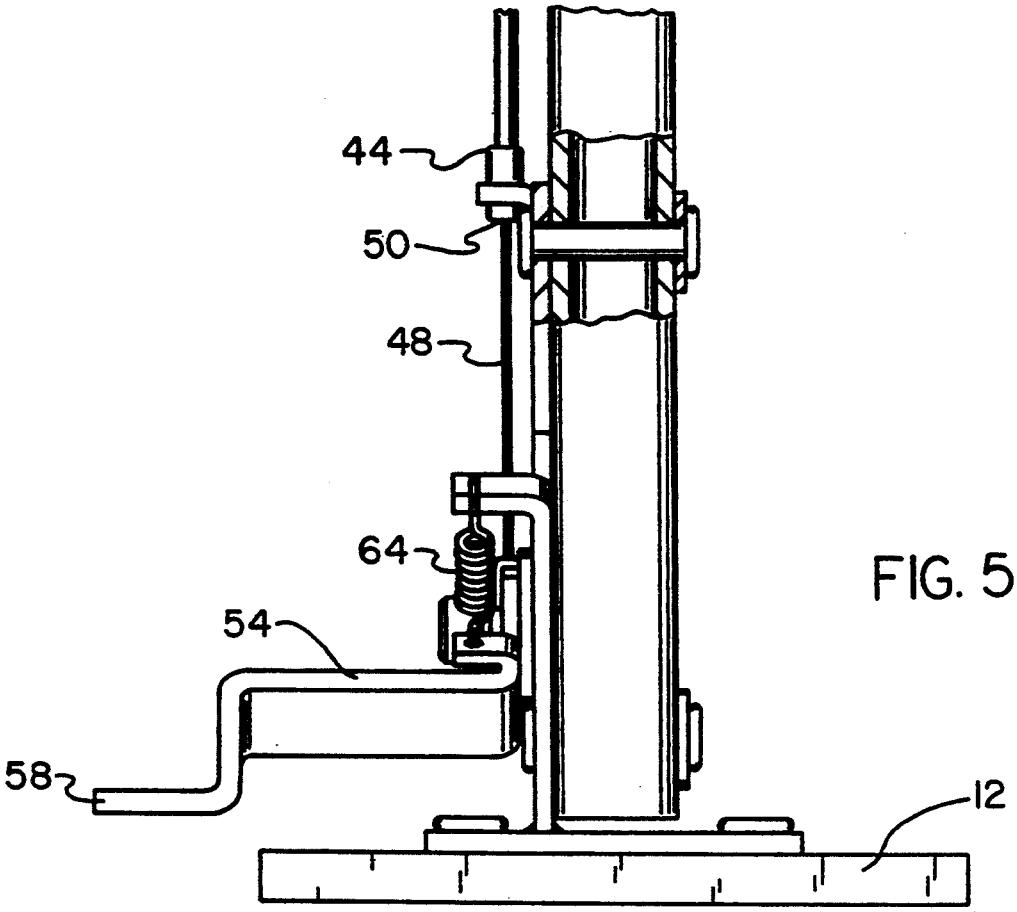
FIG. 5 is an enlarged rear view of the brake element of the present invention.
Figure 6:
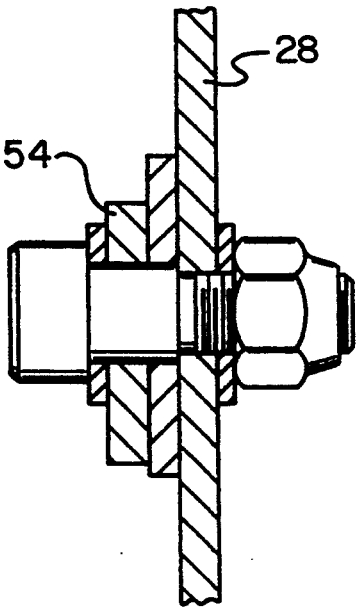
FIG. 6 is an enlarged view of the coupling means for the brake pivot.

With reference now to the drawings, and in particular, to FIG. 1 thereof, the preferred embodiment of the new and improved stabilizer device for skiers embodying the principles and concepts of the present invention and generally designated by the reference number 10 will be described.

Specifically, it will be noted in the various Figures that the device relates to a new and improved stabilizer device for skiers for aiding a beginning skier to learn the fundamentals of skiing. In its broadest context, the device consists of two skis, two front supports, two back supports, a U-shaped cross member, two brake handles, two brake cables, two drag brakes, two stop pins, and two spring mechanisms.

The device 10 consists of two skis 12, each of the two skis 12 has an upper surface and a lower surface. The two skis 12 are comprised of a plastic laminate material to keep costs of the device down.

Two front supports 14, each of the two front supports 14 has a first end 16 and a second end 18. Each second end 18 is secured to a corresponding upper surface of the two skis 12 by a fastening means. The fastening means consists of four holed securement bracket that is secured the second end of the two front supports with four threaded screws securing the bracket to the upper surface of the two skis.

Two back supports 20, each of the two back supports has a first end 22, a second end 24, and an intermediate extent 26 therebetween. Each second end 24 has a triangular support bracket 28 theresecured. Each triangular support bracket 28 is secured to a corresponding upper surface of the two skis 12 by a fastening means. The fastening means consists of a bracket secured to the triangular support and secured to the upper surface of the two skis by four threaded screws.

The device 10 contains a U-shaped cross member 30 having two convoluted end portions 32 and an intermediate extent 34 therebetween. The U-shaped cross member 30 is positioned for the intermediate extent 34 to be secured to the first end 16 of each of the two front supports 14 and to the first end 22 of each of the two back supports 20. The U-shaped cross member 30 and the front supports 14 and the back supports 20 together create an attachment that can separately be secured to any set of skis to teach a young or beginning skiers the art of skiing. The attachment can also be used for partially disabled individuals to enjoy the sport of skiing.

Two brake handles 36, each of the two brake handles 36 is secured to the intermediate extent 34 of the U-shaped cross member 30. Each of the brake handles 36 has a first securement aperture 38 therein. The brake handles strongly resemble those hand brakes employed on bicycles.

Two brake cables 40, each of the two brake cables 40 has a first end 42, a second end 44, and an intermediate extent 46 therebetween. Each first end 42 is secured to the corresponding first securement aperture 38 of the brake handle 36. Each second end 42 of the brake cable 40 is secured to the corresponding triangular support bracket 28 of the back support 20. Each intermediate extent 46 is positioned along the intermediate extent 34 of the U-shaped cross member 30 and downwardly along the intermediate extent 26 of the back support 20.

A cable extension 48 has a first end 50 and a second end 52. The first end 50 of the extension is secured to the second end 44 of the brake cable 40.

Two drag brakes 54 are secured to the corresponding triangular support brackets 28 by a fastening means. Each of the two drag brakes 54 has a first end 56, a second end 58, and an intermediate extent 60 therebetween. The first end 56 is secured to the second end 52 of the cable extension 48. The second end 58 has a generally flat surface designed to grasp snow to act as a stopping mechanism. The drab brakes are designed in a similar configuration to the safety brakes that accompany ski bindings of skis.

Two stop pins 62 are secured to the corresponding triangular support brackets 28 and are positioned above the intermediate extent 60 of the drag brake 54. The stop pins serve to prevent the drag brakes from lifting far above the snow surface it needs to stop the device.

Two spring mechanisms 64, each of the two spring mechanisms 64 has a first end 66 and a second end 68. Each first end 66 is secured to the triangular supports brackets 28. Each second end 68 is secured to the intermediate extent 60 of the drag brakes 54. The spring mechanisms serve to return the drag brake to its idle position after the drag brake is used to stop the device.

The present invention is designed for use by novice skiers, younger skiers or those who are partially disabled. It is comprised of a tubular frame and a set of brake handles. The frame is made of four angular struts and a "U" shaped cross member. The bottoms of the struts are permanently affixed to the top of each ski near each end of the ski. They extend perpendicularly from the longitudinal axis of the ski while being angled slightly inboard in the other plane.

The tops of these struts are, in turn, attached to each leg of the "U" shaped cross member side legs, with the remaining leg located across the front of the skier. This effectively joins the skis to make them operate as a single mobile unit. A spring loaded handle serves to actuate the drag brakes and is mounted near the rear end of each side member of the frame. The brake itself is a pivotally mounted lever located at the outside of the rear frame struts, and this is actuated by a cable which extends through a guide to the actuating handle.

It can be seen that one can negotiate gradual slopes while holding on to the cross bar and easily maintain balance. The speed at which one comes down the slope can be regulated by periodically squeezing the brake handle. There will be no tendency to turn since the drag is equally distributed across both skis. The present invention is ideal for use by those who would like to get the proper "feel" of skiing before attempting to use conventional ski poles. It can also be used on a permanent basis by anyone who is partially immobilized but wishes to participate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved stabilizer device for skiers for aiding a beginning skier to learn the fundamentals of skiing comprising, in combination:

two skis, each of the two skis having an upper surface and a lower surface;

two front supports, each of the two front supports having a first end and a second end, each second end secured to a corresponding upper surface of the two skis by a fastening means;

two back supports, each of the two back supports having a first end, a second end, and an intermediate extent therebetween, each second end having a triangular support bracket secured thereto, each triangular support bracket secured to a corresponding upper surface of the two skis by a fastening means;

a U-shaped cross member having two convoluted end portions and an intermediate extent therebetween, the U-shaped cross member positioned for the intermediate extent to be secured to the first end of each of the two front supports and to the first end of each of the two back supports;

two brake handles, each of the two brake handles secured to the intermediate extent of the U-shaped cross member, each of the brake handles having a first securement aperture therein;

two brake cables, each of the two brake cables having a first end, a second end, and an intermediate extent therebetween, each first end secured to the corresponding first securement aperture of the brake handle, each second end of the brake cable secured to the corresponding triangular support bracket of the back support, each intermediate extent positioned along the U-shaped cross member and downwardly along the back support, a cable extension having a first end and a second end, the first end of the extension secured to the second end of the brake cable;

two drag brakes secured to the corresponding triangular support brackets by a fastening means, each of the two drag brakes having a first end, a second end, and an intermediate extent therebetween, the first end secured to the second end of the cable extension, the second end having a generally flat surface designed to grasp snow to act as a stopping mechanism;

two stop pins secured to the corresponding triangular support brackets positioned above the intermediate extent of the drag brake; and two spring mechanisms, each of the two spring mechanisms having a first end and a second end, each first end secured to the triangular supports brackets, each second end secured to the intermediate extent of the drag brakes.

2. A stabilizer device for skiers comprising:

two skis, each of the two skis having an upper surface and a lower surface;

two front supports secured to a corresponding upper surface of the two skis;

two back supports having a triangular support bracket secured thereto, each triangular support bracket secured to a corresponding upper surface of the two skis;

a U-shaped cross member having two convoluted end portions positioned to be secured to the two front supports and to the two back supports;

two brake handles, each of the two brake handles secured to the U-shaped cross member;

two brake cables secured to the corresponding brake handle and to the corresponding triangular support bracket of the back support;

two drag brakes secured to the corresponding triangular support brackets and secured to the corresponding brake cables; and two spring mechanisms secured to the corresponding triangular supports brackets and to the drag brakes.

3. The device as described in claim 2 and further comprising:

two stop pins secured to the corresponding triangular support brackets and positioned above the corresponding drag brakes.

* * * * *